US006813870B2

(12) United States Patent
Iwamoto

(10) Patent No.: US 6,813,870 B2
(45) Date of Patent: Nov. 9, 2004

(54) METHOD AND APPARATUS FOR INSERTING INSERT MATERIAL INTO AN ENVELOPE

(75) Inventor: Yasuhiko Iwamoto, Obu (JP)

(73) Assignee: Kabushiki Kaisha Some Giken, Tokai (JP)

( * ) Notice: Subject to any disclaimer, the term of this patent is extended or adjusted under 35 U.S.C. 154(b) by 0 days.

(21) Appl. No.: 10/194,024

(22) Filed: Jul. 12, 2002

(65) Prior Publication Data

US 2003/0009991 A1 Jan. 16, 2003

(30) Foreign Application Priority Data

Jul. 13, 2001 (JP) ..... 2001-214275

(51) Int. Cl.[7] ..... B65B 11/48

(52) U.S. Cl. ..... 53/460; 53/255; 53/381.6; 53/475; 53/535; 53/540; 53/569

(58) Field of Search ..... 53/460, 473, 475, 53/147, 531, 535, 540, 544, 569, 381.6, 255, 235

(56) References Cited

U.S. PATENT DOCUMENTS

| | | | | | |
|---|---|---|---|---|---|
| 2,569,219 | A | * | 9/1951 | Bamber | 53/569 |
| 2,835,090 | A | * | 5/1958 | Maine | 53/569 |
| 3,131,519 | A | * | 5/1964 | Webster | 53/117 |
| 4,077,181 | A | | 3/1978 | Asher et al. | |
| 4,270,747 | A | * | 6/1981 | Templeton | 271/179 |
| 5,372,360 | A | * | 12/1994 | Ricciardi | 271/177 |
| 5,409,206 | A | * | 4/1995 | Marzullo et al. | 271/179 |
| 5,765,827 | A | * | 6/1998 | Gillmann | 271/300 |
| 5,802,808 | A | | 9/1998 | Lyga | |
| 5,954,323 | A | | 9/1999 | Emigh et al. | |
| 5,975,514 | A | | 11/1999 | Emigh et al. | |
| 6,155,031 | A | | 12/2000 | Ballestrazzi et al. | |
| 6,502,812 | B2 | * | 1/2003 | Belec | 270/52.02 |

* cited by examiner

*Primary Examiner*—Eugene Kim
*Assistant Examiner*—Christopher Harmon
(74) *Attorney, Agent, or Firm*—Foley Hoag LLP

(57) ABSTRACT

A method and an apparatus of inserting insert or enclosure material into successive envelopes are disclosed. According to the envelope inserting method, the insert material is conveyed along a straight path successively to an envelope inserting position where the insert material is inserted into the envelope and the stuffed envelope is then conveyed out of the inserting position in the same direction as the above straight path. The method includes providing immediately above the envelope inserting position an envelope storage station where a plurality of envelopes are stored in a stack one above another with the front panel of each of the envelopes facing upward so that the envelopes in the storage station are fed successively to the envelope inserting position for insertion thereinto of insert material. Feeding of the envelopes is performed by means of a vertically disposed rotatable screw-like spiral member located at the downstream side of the envelope storage station as seen in the direction in which the insert material is conveyed. The spiral member has formed in the periphery thereof a spiral groove for receiving therein the bottom edges of the respective envelopes, thereby holding such envelops at the bottom edges thereof such that the bottom edges are separated one from another. The spiral member is rotatable in such a direction that causes the bottom edges of the envelopes to move downwards with the rotation of the spiral member and then to be released successively from the holding by the spiral member.

21 Claims, 9 Drawing Sheets

METHOD AND APPARATUS FOR INSERTING INSERT MATERIAL INTO AN ENVELOPE

BACKGROUND OF THE INVENTION

1. Field of the Invention

The present invention relates to a method and an apparatus of inserting insert or enclosure material such as sheets of document, booklet and the like into an envelope which is made of paper, plastic film or any other appropriate materials. More specifically, the invention relates to envelope inserting method and apparatus which makes possible improvement in the envelope inserting efficiency by permitting the insert material to flow in a continuous, streamlined manner.

Envelopes are available in various shapes and sizes, including oblong-shaped envelopes having a flap portion on the longer side or the shorter side thereof, envelops with predetermined sizes prescribed by the post office and various sizes determined according to the content document sizes such as international A5, A4 and A3 sizes, and various DL envelopes with an outlook window.

The present invention is applicable not only to such envelopes of various shapes and sizes, but also to various forms of contents to be inserted or enclosed in the envelopes, including a plurality of cut sheets laid in a bundle, insert material folded in half, third or fourth, brochure or books saddle stitched or perfect bound and collated insert material. It is noted that in this specification these enclosure contents to be inserted into envelopes are generally referred to as "insert material." As is apparent in the art, after the insert material has been inserted, the envelope is closed and sealed by its flap. The present invention is directed to the method and apparatus of envelope inserting which is performed preceding such flap closing and sealing process.

2. Description of the Related Art

For better understanding to the background underlying the present invention, reference is made to FIG. 2 which shows a typical known method of envelope inserting. As seen in the drawing, insert material 1 is being inserted as indicated by arrow 3 into an envelope 2 which is then located at envelope inserting position through an opened throat of the envelope. A preceding envelope 2*a* having the insert material 1 already inserted therein is transferred in the direction of arrow 3*a* and a succeeding empty envelope 2*b* is transferred toward the envelope inserting position as indicated by arrow 3*b*.

As would be appreciated from the drawing, the conventional envelope inserting method is characterized in that all operations involved with the envelope inserting, including insertion of the insert material 1 and the transferring of envelopes 2, 2*a*, 2*b*, are performed in a horizontal plane. Another feature of the prior art method resides in the change of moving direction of the insert material 1. That is, the insert material 1 is moved in the arrow direction 3 to be inserted into the envelope 2, while the insert material 1 thus inserted into the envelope is then moved in the direction 3*a* that is perpendicular to the inserting direction 3.

The distance for which the insert material 1 must be moved for insertion into the envelope 2 generally depends on the size of the envelope as measured in the arrow direction 3. Accordingly, longer time is required for the insert material 1 to be inserted completely with an increase of the above size of the envelope. An attempt may be made to design an apparatus which can speed up the envelope inserting operation, although this will only invite complication and hence higher cost of the apparatus.

On the other hand, the change of moving direction of the insert material 1 means that insert material 1 and the envelop receiving such material must make a temporary stop before the insert material 1 changes the direction of its movement. If a number of successive sets of insert material 1 is fed continuously toward the envelope inserting position at a predetermined speed, any two successive or adjacent sets of insert material 1 must be fed at a sufficiently spaced interval. This will inevitably limit the envelope inserting operation speed, thus making it difficult to achieve today's need for high-speed envelope stuffing operation.

SUMMARY OF THE INVENTION

Therefore, it is an object of the present invention to provide a method of envelope inserting which is operable at a rate exceeding what has been achievable by conventional methods by allowing the envelopes and the insert material to move in a rational manner.

It is another object of the invention to provide an apparatus for practicing the this envelope inserting method.

To achieve the objects of the invention, the invention provides an envelope inserting method wherein the insert material is conveyed along a straight path successively to an envelope inserting position where the insert material is inserted into the envelope and the stuffed envelope is then conveyed out of the inserting position in the same direction as the above straight path. For this purpose, the method of the invention includes providing immediately above the envelope inserting position an envelope storage station where a plurality of envelopes are stored in a stack one above another with the front panel of each of the envelopes facing upward so that the envelopes in the storage station are fed successively to the envelope inserting position for insertion thereinto of insert material.

In the preferred embodiment of the invention, feeding of the envelopes is performed by means of a vertically disposed rotatable screw-like spiral member located at the downstream side of the envelope storage station as seen in the direction in which the insert material is conveyed. The spiral member has formed in the periphery thereof a spiral groove for receiving therein the bottom edges of the respective envelopes, thereby holding such envelops at the bottom edges thereof such that the bottom edges are separated one from another. The spiral member is rotatable in such a direction that causes the bottom edges of the envelopes to move downwards with the rotation of the spiral member and then to be released successively from the holding by the spiral member.

According to this method, each empty envelope has to move only for an extremely short distance to the envelope inserting position and the insert material does not have to change its direction of movement after it has been inserted into an envelope, with the result that the flow of the insert material can be streamlined and very smooth and, therefore, a remarkable speedup and improvement in the envelope inserting efficiency can be achieved.

The spiral member as the envelope feeding means can also serve to hold the envelope at its bottom edge in the envelope storage station, so that the lowermost envelope in the storage station which is subjected to frictional contact with the stuffed envelope then moving away from the envelope inserting position can be prevented from being dragged and dislocated by the movement of the stuffed envelope.

The present invention also provides an envelope inserting apparatus which comprises conveyer means for conveying the insert material along a straight path toward an envelope inserting position of the apparatus where the insert material is inserted by the conveyer means into the envelope through an opened throat and then conveying the stuffed envelope out of the envelope inserting position along the same straight path, an envelope storage station provided immediately above the envelope inserting position for storing a plurality of empty envelopes in a stack one above another with the front panel of each of the envelopes facing upwards, and throat opening means disposed adjacent to the upstream side of the envelope storage station, as viewed in the direction in which the insert material is conveyed, and operable to be brought into contact with the throat portion of envelope for opening the throat of that envelope. The envelope storage station is defined on the upstream side thereof by a flap guide member for guiding the flap portions of the envelopes and on the opposite downstream side by envelope feed means for feeding the envelopes successively to the envelope inserting position.

The conveyer means include a pushing member which is adapted to be brought into engagement with the trailing end of the insert material to push the material forward into the envelope and then into engagement with the throat portion of the rear panel of the envelope thereby to push the envelope out of the envelope inserting position along the above straight path. The envelope feed means is provided by a vertically disposed rotatable spiral member of the same structure and operable in the same manner as described in the above with reference to the envelope inserting method. The envelope inserting apparatus thus constructed can offer the above-described features and advantages.

Thus, the envelope inserting method and apparatus according to the invention can make possible remarkable improvement in working efficiency, thereby contributing greatly to fulfillment of today's demand for further speedup in operation and the economy of the related industry.

The above and other objects, features and advantages of the invention will become apparent to those skilled in the art from the following description of preferred embodiments of the envelope inserting method and apparatus according to the present invention, which description will be made with reference to the accompanying drawings, wherein:

DESCRIPTION OF THE PREFERRED EMBODIMENTS

Figure 1:
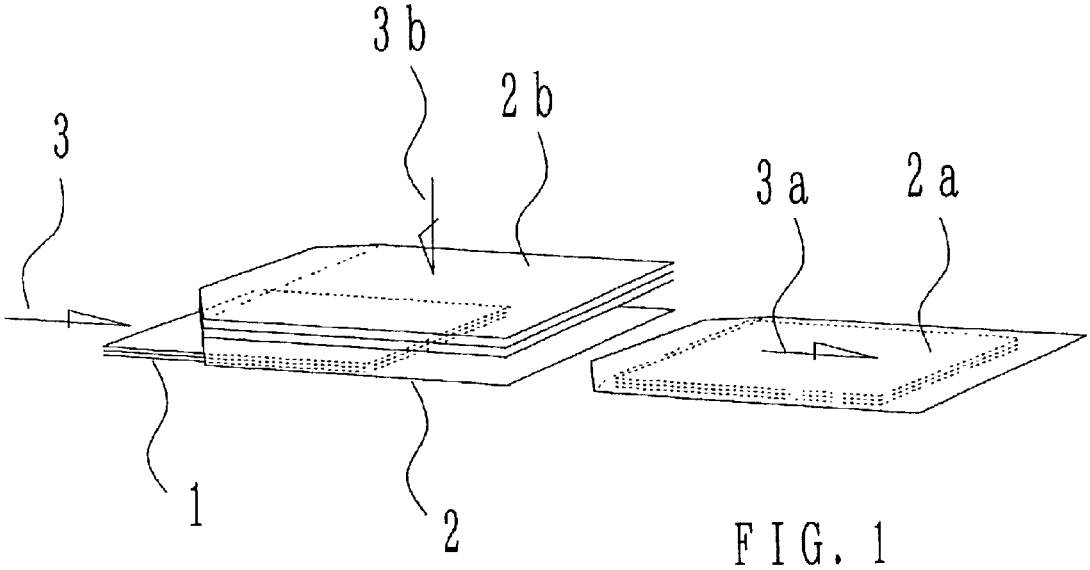
FIG. 1 is a schematic perspective view showing the principle of envelope insertion according to the present invention.
Figure 2:
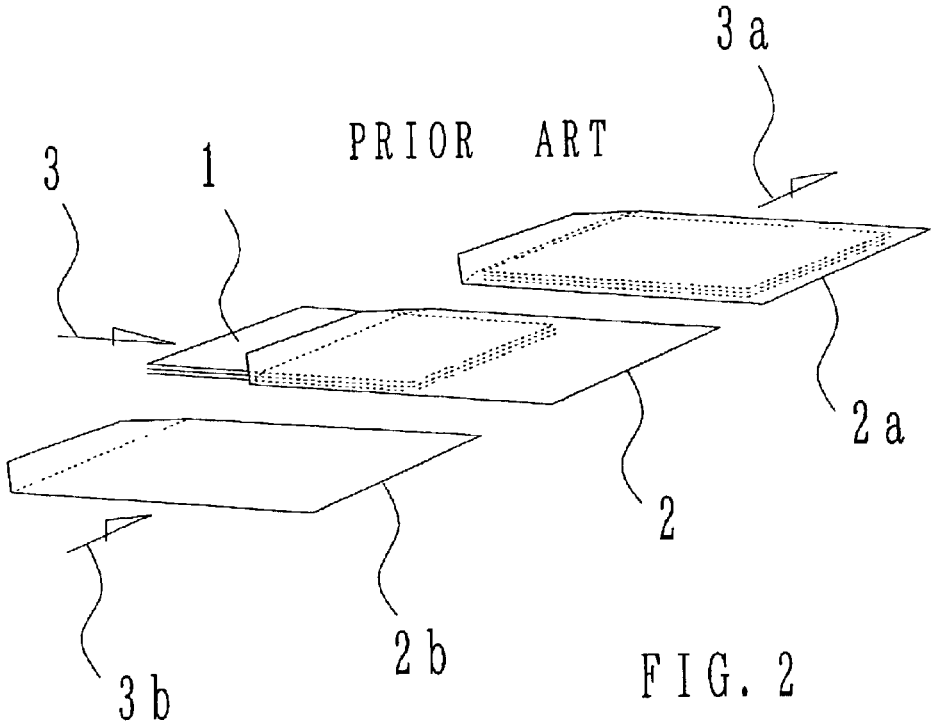
FIG. 2 is a schematic perspective view showing a conventional method of envelope inserting.

Reference is firstly made to FIG. 1 which shows the basic principle of envelope inserting operation according to the present invention. The drawing specifically shows the arrangement of empty envelopes 2*b* and the directions 3 and 3*a* in which the insert material 1 is being moved for insertion into an envelope 2 through an opened throat at the envelope inserting position and the stuffed envelope 2*a* is moved out of the envelope inserting position, respectively. It is noted that a plurality of empty envelopes 2*b* are arranged one above another in the form of a stack immediately above the envelope inserting position and such empty envelopes 2*b* are fed successively to the envelope inserting position as indicated by arrow direction 3*b*.

As is apparent from the drawing, the stuffed envelope 2*a* having inserted therein the insert material 1 is conveyed in the arrow direction 3*a* that is the same as the arrow direction 3 in which the insert material 1 is moved for insertion into the envelope 2. Since the material inserting and the subsequent transferring of the stuffed envelope can be accomplished by movement thereof in the same direction, the envelope inserting operation can be continuously streamlined and, therefore, a remarkable improvement in speeding up the envelope inserting operation can be achieved, regardless of whether the insert material movement is stopped temporarily after the insertion thereof into an envelope or the insertion and the subsequent transferring are performed without interruption of the insert material movement.

After the stuffed envelope 2*a* has moved out of the inserting position, or alternatively during the movement of the envelope in the envelope inserting position away therefrom as in the preferred embodiment which will be described more in detail in later part hereof, the lowermost empty envelope 2*b* in the stack immediately above the envelope 2 is moved down as indicated by arrow 3*b* to the inserting position to receive the next insert material (not shown). As is understood readily from the drawing, the distance which the lowermost envelope 2*b* has to move to the inserting position is extremely small and the time required for such envelope movement is quite short, accordingly. The plurality of the empty envelopes 2*b* is temporarily stored in the envelope storage station which will be described more in detail later hereinafter, and the number of such envelopes 2*b* to be prepared in the storage station should be determined so that the stack of the empty envelopes 2*b* will not exert an excessive resistance against the insertion of insert material 1 into the envelope 2 at the envelope inserting position. As a matter of course, when it is desired to operate the envelop inserting apparatus in a continuous manner, the envelope storage station may be replenished by successive additional empty envelopes 2*b* either manually or automatically so as to maintain the desired number of empty envelopes 2*b* in the envelope storage station.

Figure 3:
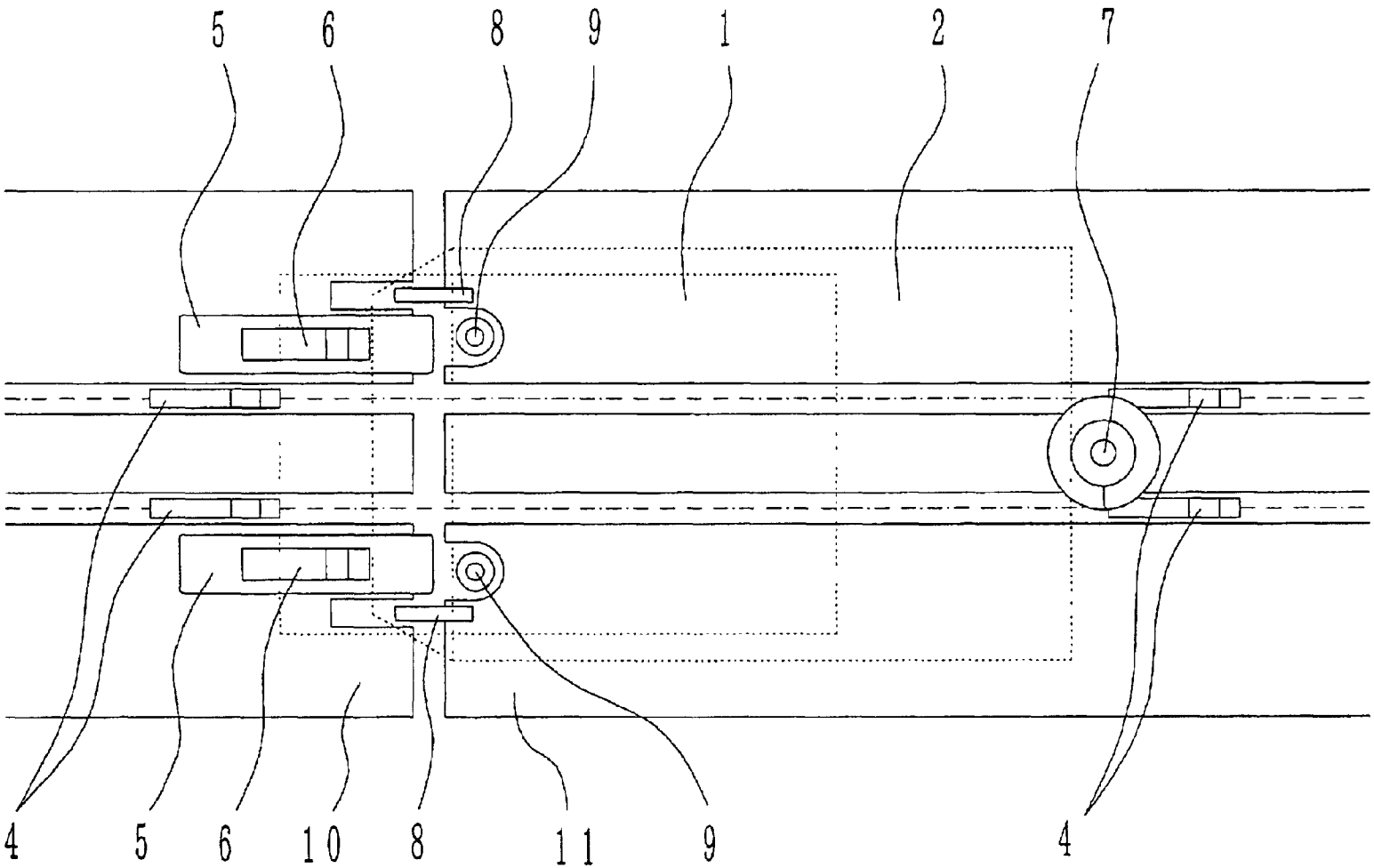
FIG. 3. is a plan view showing an embodiment of envelope inserting apparatus constructed according to the present invention.
Figure 4A:
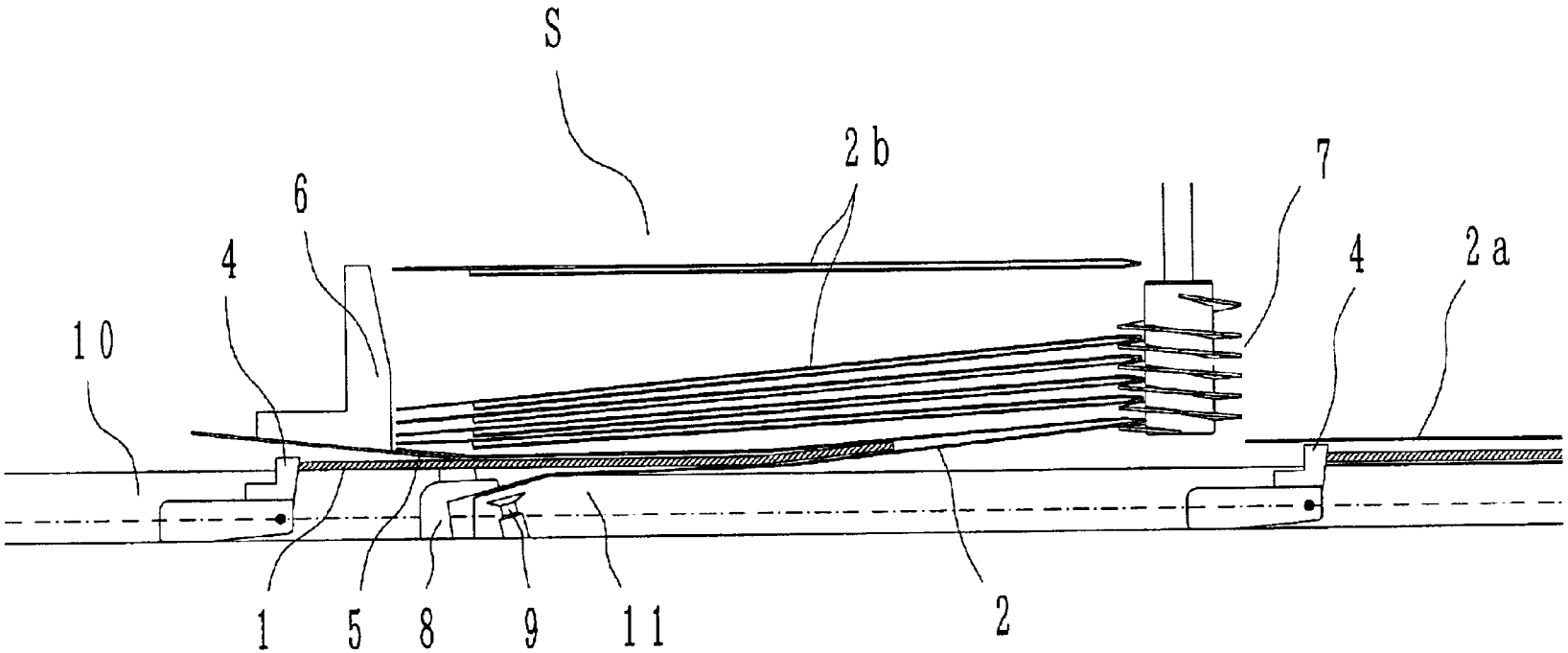
FIGS. 4A through 4C are side views of the envelope inserting apparatus of FIG. 3, illustrating the envelope inserting operation by showing three different states thereof in time series.
Figure 4B:
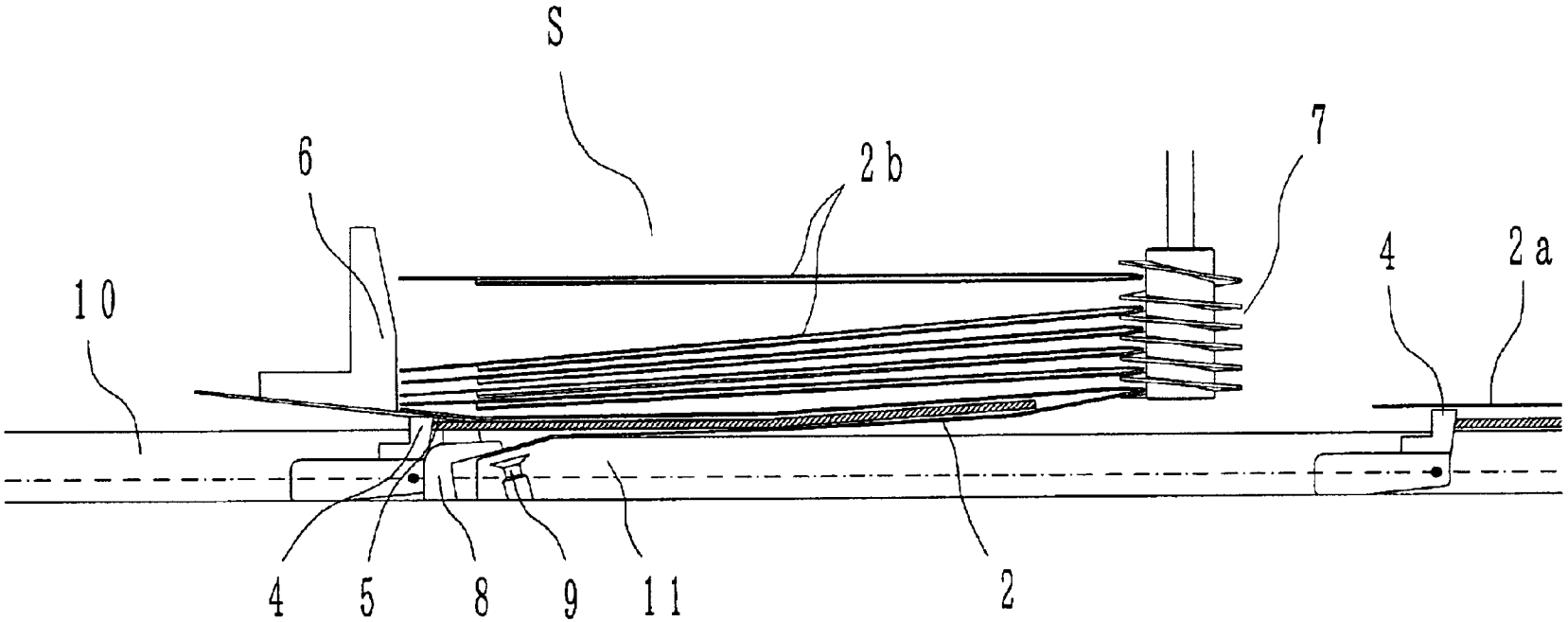
Figure 4C:
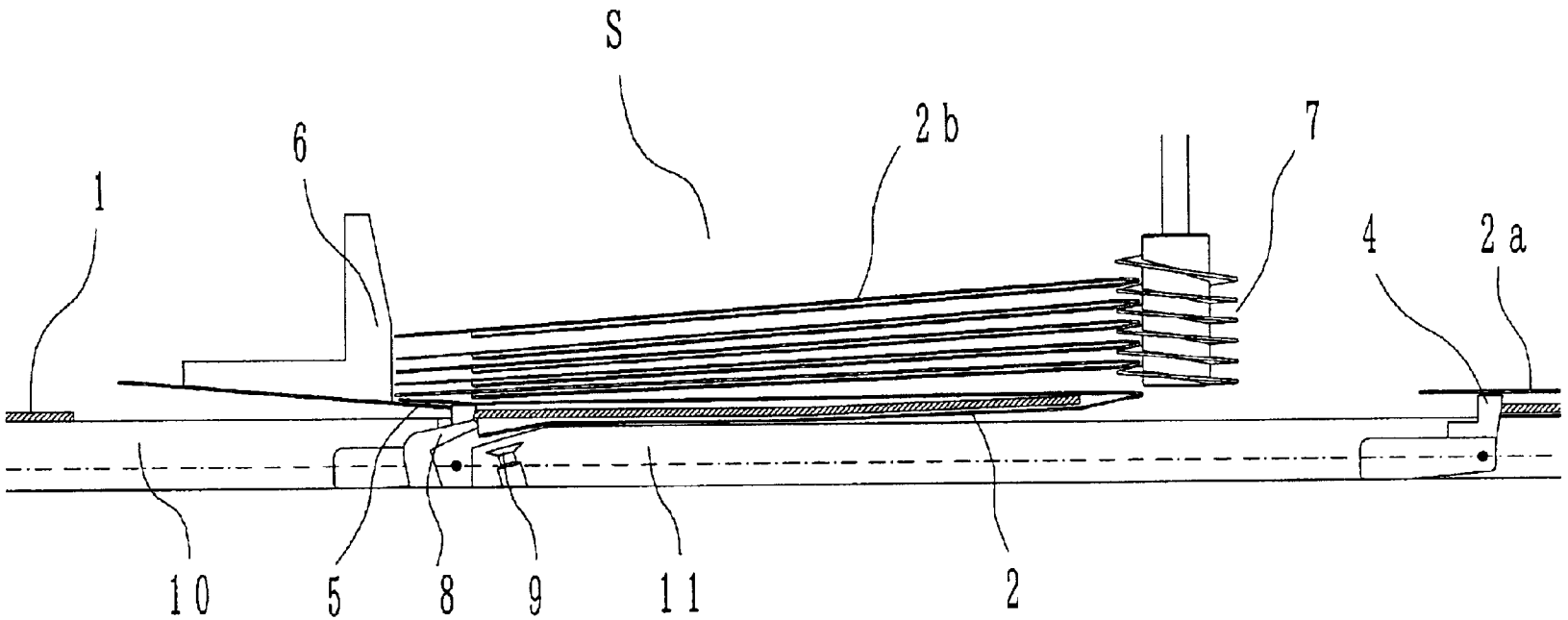
Figure 5A:
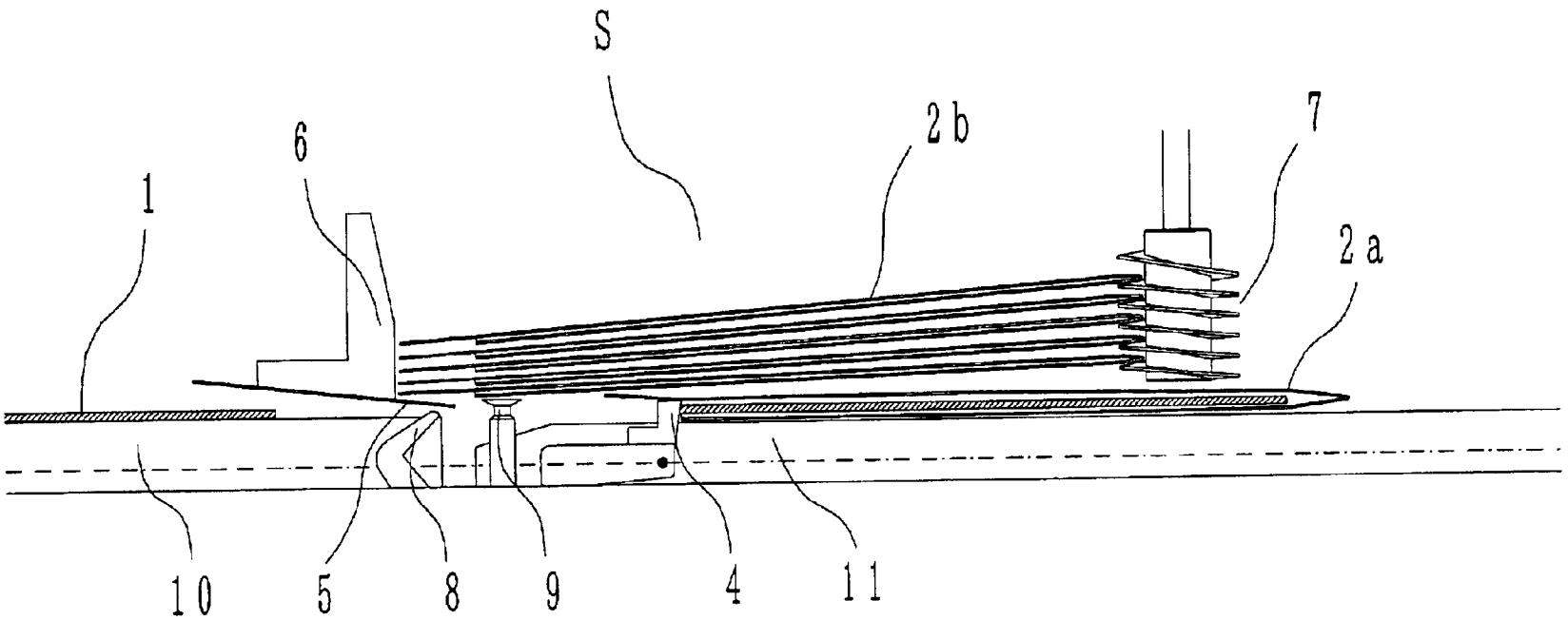
FIGS. 5A through 5C are side views showing further three different states during envelope inserting operation, as well as the operation for opening an envelope throat.
Figure 5B:
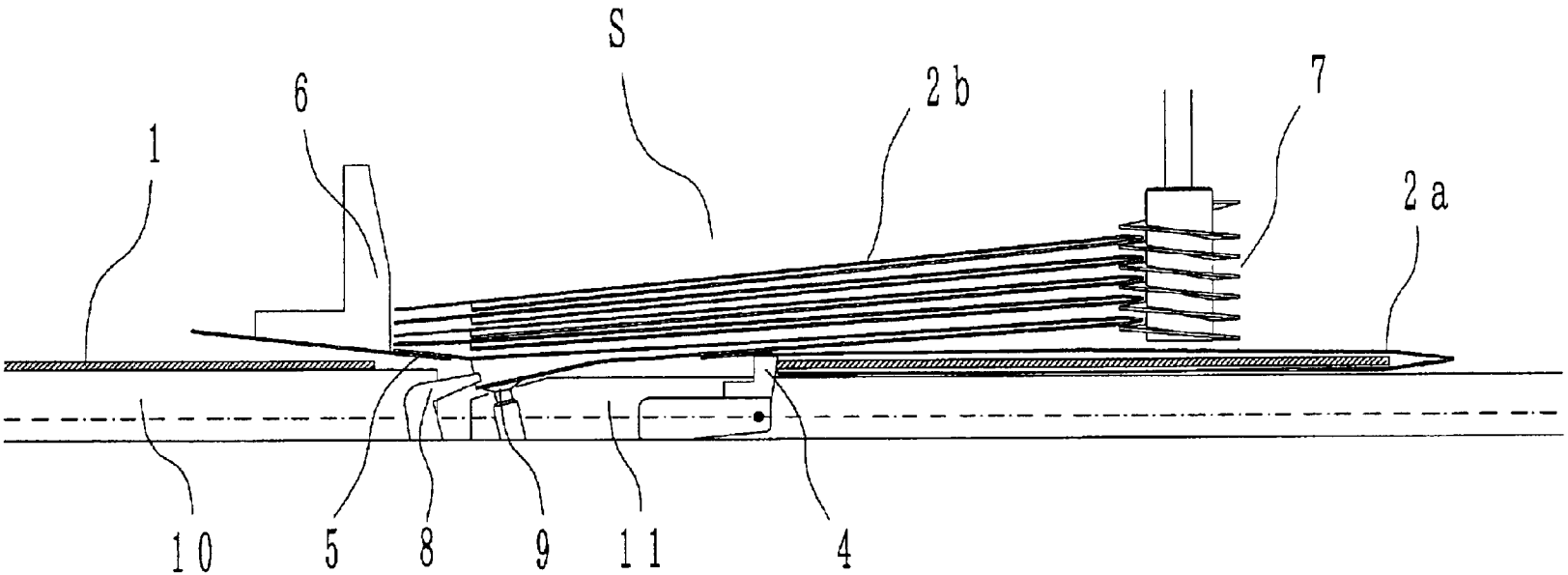
Figure 5C:
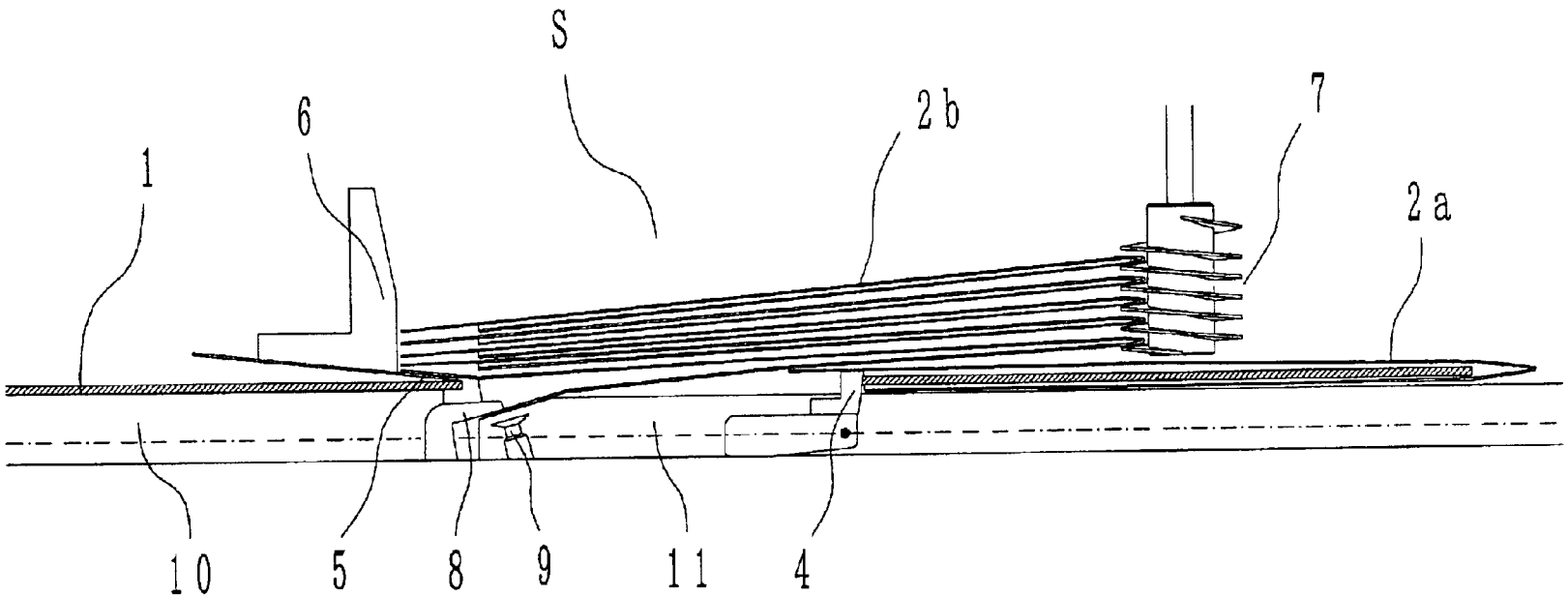

The following will described the preferred embodiment of the invention more in detail while having reference to FIGS. 3, 4 and 5. Of these drawings, FIGS. 4A through 4C and FIGS. 5A through 5C show various states during the envelope inserting operation and other operations associated therewith in time sequence.

Referring firstly to FIG. 3 and FIGS. 4A through 4C, reference numeral 4 designates pairs of movable pushing members in the form of paired fingers for pushing or thrusting the insert material 1 into the envelope 2 and then conveying the stuffed envelope 2*a* out of and away from the envelope inserting position. In the drawings of FIGS. 4A through 4C, the paired pusher fingers 4 on the left hand side are pushing the insert material 1 from left to right on the drawings in engagement with the trailing end of the insert material 1, while the paired fingers 4 on the right hand side are pushing the stuffed envelope 2*a* in the same direction away from the envelope inserting position in engagement with the throat portion of the envelope 2*a*.

Though not shown fully in the drawings, the envelope inserting apparatus includes a front table 10 and a rear table 11 and a plurality of such pairs of pushing fingers 4 are fixedly mounted at a predetermined spaced interval to a pair of endless bands such as chains which are adapted to run in grooves formed in the front and rear tables 10 and 11, respectively, with the top portions of the fingers 4 projecting beyond the table surfaces so that the fingers 4 are brought into contact engagement with the upstream or trailing end of the insert material 1. Thus, the paired pushing fingers 4 are moved successively past the envelope inserting position as the bands are driven to move along an endless path. Though plural pairs of pusher fingers 4 are provided in the illustrated embodiment, fingers along a single line or groove in the tables 10 and 11 may be used depending on the throat profile of envelopes to be handled.

As seen in FIG. 4A, each empty envelop 2*b* is set in a envelope storage station S with the front panel thereof having a flap facing upward.

The envelope storage station S is defined by a pair of flap guides 6 provided on the upstream side of the storage station S for locating the empty envelopes 2*b* at their flaps in contact engagement therewith and a spiral envelope feeder 7 disposed on the opposite downstream side of the storage station S. A flap support plate 5 is formed integrally with each of the flap guides 6 to support the lower surface of envelope flap.

As clearly seen in FIGS. 4A through 4C, the spiral envelope feeder 7 is provided in the form of a rotatable upstanding screw having a spiral ridge which in turn defines a spiral groove. The empty envelopes 2*b* are supported and held at their bottom edges in the spiral groove of the spiral feeder 7 such that the bottom edges are separated one above another by the spiral groove as shown in the drawings. The beginning and terminating ends of the spiral groove are open and the spiral feeder 7 is driven to rotate in clockwise direction as viewed in FIG. 3 so that the empty envelopes 2*b* are fed successively downward and the bottom edge of the lowermost envelope 2*b* in the storage station S is released from the spiral groove of the spiral feeder 7 with the rotation thereof. For this purpose, it is so arranged that the envelope spiral feeder 7 should be rotatable in synchronism with the movement of the pushing forgers 4 in such a way that the release of the bottom edge of the envelope from the spiral feeder occurs at latest when the insertion of the insert material 1 by the fingers 4 into that envelope 2 has been completed. Rotation of the spiral feeder 7 in the above direction make possible reception of a new empty envelope 2*b* for replenishment of the envelope storage station 5, as shown in FIGS. 4A and 4B.

As clearly seen in FIGS. 4A through 4C, the beginning portion of the spiral groove of the envelope feeder 7 is formed wider than the rest of the groove so that an empty envelope 2*b* for replenishment is received easily and assuredly by the spiral groove. As a matter of fact, the spiral groove width should be wide enough to receive loosely therein the bottom edges of the empty envelopes 2*b* and the spiral feeder 7 should be made with the desired number of spiral turns depending on the number of empty envelopes 2*b* to be held in the envelope storage station S. Additionally, the flap guides 6 and the spiral envelope feeder 7 should be spaced desirably by a distance that is large enough to hold the envelopes 2*b* loosely in the storage station S.

The envelope inserting apparatus of the illustrated embodiment further includes a pair of clamps 8 located adjacent to the flap guides 6 and operable to move between their operative position where the clamps 8 are inserted slightly into an opened throat of the envelope and hold the envelope at the throat portion as shown in FIGS. 4A and 4B and the inoperative position where the clamps 8 are retracted as shown in FIG. 4C. The apparatus still further has a throat opening device 9 disposed adjacent to the flap guides 6 and including a pair of suction cups which are movable to be brought into contact with and hold the throat portion of the envelope by suction as shown in FIG. 5A and pull down the throat portion to open the throat of the envelope as shown in FIG. 5B.

Referring again to FIGS. 4A through 4C showing three different states during envelope inserting operation, the insert material 1 is being inserted by the advancing pusher fingers 4 into the envelope 2 through an opened throat of the envelope 2 as shown in FIG. 4A. The insert material 1 is inserted deeper into the envelope 2 in FIG. 4B with further advancement of the pusher fingers 4. In these two states, the envelope throat is kept open by the clamps 8 and the bottom edge of the envelope 2 is held in the spiral groove of the spiral feeder 7. FIG. 4C depicts a state wherein the insert material 1 has been substantially fully inserted into the envelope 2. In this state, holding of the throat portion of the envelope 2 by the clamps 8 is released and the bottom edge thereof is also released from the spiral groove of the envelope feeder 7. It is noted that in the state of FIG. 4A a new empty envelope 2*b* is being supplied to replenish the envelope storage station S and that in the state of FIG. 4B the bottom edge of the empty envelope 2*b* is just received in the groove of the spiral feeder 7.

For successful envelope insertion, it is necessary for the pusher fingers 4 to exert to the insert material 1 a thrusting force that is strong enough to overcome the resistance of envelope insertion. On the other hand, it is necessary for the envelope 2 to be held steadily enough to resist the thrusting force exerted by the paired fingers 4. For this purpose, the clamps 8 hold the envelope 2 at its throat portion while keeping the throat opened. To be more specific, the clamps 8 are operable to be inserted slightly into envelope 2 through its opened throat before the envelope insertion begins and to hold down the throat portion of the lower or rear panel of the envelope 2 against the oblique surface at the upstream end portion of the rear table 11, as clearly shown in FIGS. 4A and 4B. Throat opening operation by the suction cups of the throat opening device 9 will be described in detail later with reference to FIGS. 5A through 5C.

In the illustrated embodiment, the bottom edge of the envelope 2 is held by engagement with the spiral groove of the envelope spiral feeder 7 in the states of FIGS. 4A and 4B where the envelope is held at its throat portion by the clamps 8. It is to be noted, however, that the spiral feeder 7 may be rotatable in synchronism with the operation of the clamps 8 in such a way that the holding of the envelope bottom edge by the spiral groove of the feeder 7 is releasable after the envelope has been held at its throat portion by the clamps 8. As a matter of course, the envelope 2 must be released from the clamps 8 when the envelope inserting has been completed as shown in FIG. 4C. For this purpose, it is so arranged that the clamps 7 are operable synchronously with the movement of the pushing fingers 4 in such a way the clamps 8 are operated to release the holding of the envelope at its throat portion when insertion of the insert material into the envelope has been completed.

Now referring specifically to FIGS. 5A through 5C, these drawings show movement of the stuffed envelope 2*a* away from the envelope inserting position, as well as the operation of the clamps 8 and the suction cups of the throat opening device 9 for opening the throat of the subsequent envelope 2 released from the envelope spiral feeder 7. As shown in the drawings, while the stuffed envelope 2*b* is being conveyed away from the envelope inserting position, the envelope 2*b* at the bottom of the storage is placed to the envelope inserting position for receiving the next insert material 1.

As would be appreciated from the drawings, the lowermost envelope 2*b* in the storage station S tends to droop by its own weight and, therefore, is subjected to frictional contact with the envelope 2*a* then moving away from the envelope inserting position, thus tending to be dragged and hence dislocated by the moving stuffed envelope 2*a*. However, the spiral envelope feeder 7 serves to keep the envelope 2*b* in place without being dragged or dislocated by the moving stuffed envelope 2*a*, so that the subsequent throat opening of the envelope 2*b* can be performed steadily.

FIG. 5A shows a state where the stuffed envelope 2*a* has already moved past the throat portion of the empty envelope 2*b* at the bottom of the stack in the storage station S and the throat opening device 9 is operated to move the suction cups upward into contact with the throat portion of the envelope 2*b*. In FIG. 5B, the suction cups are then moved downward to pull the envelope throat portion to spread open the envelope by the action of vacuum in a known manner. In conjunction this throat opening operation, the clamps 8 are energized to hold the throat portion of the envelope and to keep the throat open. After the throat of the envelope 2 has been held by the clamps 8, the suctions cups are deenergized and refracted, as shown in FIG. 5C. As is well known in the art, suctioning operation for the throat opening device 9 can be controlled by means of suitable devices such as mechanical valve or electromagnetic valve. As would be appreciated from FIG. 5A, the throat opening device is operable in synchronism with the movement of the pushing fingers 4 such that the suction cups of the device 9 are moved into contact with the throat portion of the envelope 2*b* after the flap of the preceding stuffed envelope 2*a* has moved past the throat opening device 9.

Though the preferred embodiment of the envelope inserting apparatus illustrated in the drawings uses the clamps 8, the apparatus may dispense with such clamps 8 depending on the kind of envelopes to be stuffed with insert material 1. For example, the throat of envelopes made of resin film or the like or envelopes made of relatively thick paper can be kept open only by the vacuum of the suction cups. In such a case, the suction cups are kept in operative state until the insert material 1 has been completely inserted into an envelope 2. That is, the throat opening device 9 is operable in synchronism with the rotation of the spiral envelope feeder 7 in such a way that the releasing of the bottom edge of the envelope from spiral feeder 7 occurs after the suction cup has been brought into contact with the throat portion of the envelope.

In the illustrated embodiment, the suctions cups are deenergized and retracted after the clamps 8 are operated to move to their clamping position, the suction cups may remain in operative state so that the throat portion of the envelope is kept open by both of the suction cups and the clamps 8.

For continuously inserting the insert material 1 into successive envelopes, the state shown in FIG. 5C is followed by the state shown in FIG. 4A, and the steps of operation in the above-described time sequence are repeated.

In the envelope inserting operation in the illustrated apparatus, the flap support plate 5 formed integrally with each of the flap guides 6 does not only perform the function of supporting the flap of an empty envelope 2*b* from the bottom, but also serves to guide the upper surface of the insert material 1. For smooth insertion of the insert material, therefore, more than two of such flap support plates 5 may be provided to guide the insert material 1 over a larger area.

Similarly, the clamps 8 can double as the guide for the insert material 1. That is, the upper surfaces of the clamps 8 can guide the lower surface of the insert material 1 when the material is moving through the opened throat into the envelope. For the same purpose of smooth insertion of the insert material 1, more than two of such clamps 8 may be provided to offer guiding surface over a wider area.

Figure 6:
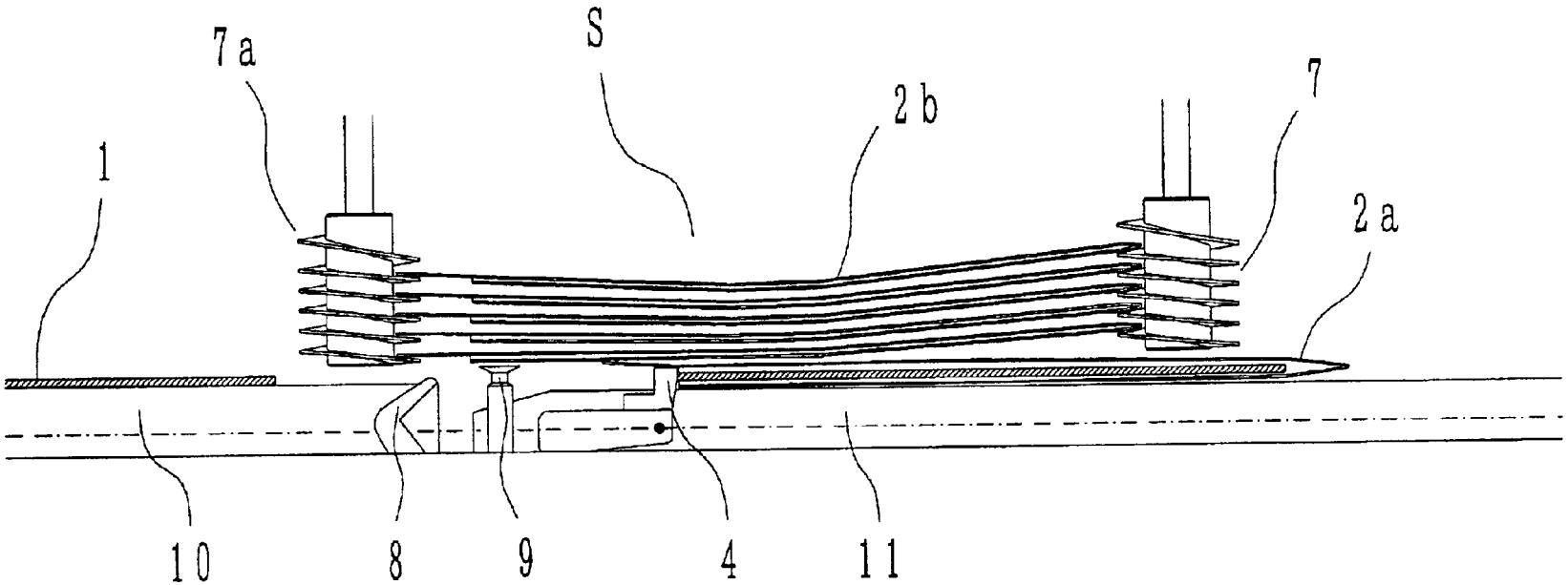
FIG. 6 is a side view showing a modified embodiment of the envelope inserting apparatus according to the present invention.

Now referring to FIG. 6 showing a modified embodiment of the invention, this embodiment differs from the above-described preferred embodiment in that the flap guides 6 are substituted by spiral type feeder 7*a* which is substantially identical to the spiral feeder 7. In so constructing the apparatus, the empty envelopes 2*b* are supported and held at their flaps by the spiral groove of the spiral feeder 7*a* and at the bottom edges by the spiral groove of the feeder 7, respectively, such that both the flaps and the bottom edges of envelopes 2*b* are separated one above another by the spiral groove as shown in FIG. 6. The feeders 7*a* and 7 are driven to rotate synchronously in the same direction to feed the empty envelopes 2*b* successively toward the envelope inserting position and to allow the envelope 2*b* at the at lowermost position in the storage station S to be dropped by its own weight when the flap and the bottom edge thereof are released from the spiral groove.

As in the first preferred embodiment, the modification of FIG. 6 may dispense with the clamps 8 if the suctions cups of the throat opening device 9 can keep the envelope throat open without using the clamps 8.

Since the provision of lateral guides of any appropriate form such as bar or plate designed to regulate the widthwise dislocation of envelopes is apparent to those skilled in the art, such devices are omitted from the description and illustration.

While the invention has been described and illustrated with reference to the specific embodiments, it is to be understood that the invention can be practiced in other various changes and modifications without departing from the spirit or scope thereof.

What is claimed is:

1. A method of successively inserting insert material into envelopes each having a rear panel and a front panel with a flap portion at one end of the envelope, comprising steps of:

conveying said insert material along a straight path successively to an envelope inserting position where the insert material is inserted into the envelope;

opening the throat of the envelope at said envelope inserting position by means of throat opening means;

providing immediately above said envelope inserting position an envelope storage station where a plurality of envelopes are stored in a stack one above another with the front panel of each of the envelopes facing upward;

feeding the envelopes in said storage station successively to said envelope inserting position for insertion thereinto of said insert material; and conveying the envelope having the insert material inserted therein out of said envelope inserting position in the same direction as said straight path, said conveying of the insert material and said conveying of the envelope are performed by conveying means which is movable only in one direction along said straight path said conveying means engaging the insert material to convey said insert material along said straight path and into said envelope at said envelope inserting position and then said conveying means engaging said rear panel of said envelope to convey said envelope out of said envelope inserting position.

2. An envelope inserting method according to claim 1, wherein said feeding the envelopes is performed by means of a vertically disposed rotatable screw-like spiral member provided at the downstream side of said envelope storage station and having formed in the periphery thereof a spiral groove for receiving therein the bottom edges of the respective envelopes thereby to hold such envelops at the bottom edges in such a way that the bottom edges are separated one from another, and said spiral member being rotatable in such a direction that causes the bottom edges of the envelopes to move downwards with the rotation of said spiral member and then to be released successively from the holding by said spiral member.

3. An envelope inserting method according to claim 2, wherein said spiral member is rotatable in synchronism with said conveying of the insert material in such a way that the release of the bottom edge of the envelope from the holding by said spiral member occurs at latest when the insertion of the insert material by said conveying into that envelope has been completed.

4. An envelope inserting method according to claim 2, wherein said throat opening is performed by means of a suction cup which is movable to be brought into contact with and then to pull down the throat portion of the envelope thereby to spread open the envelope throat.

5. An envelope inserting method according to claim 4, wherein said suction cup is movable in synchronism with the rotation of said spiral member in such a way that the releasing of the bottom edge of the envelope from said spiral member occurs after said suction cup has been brought into contact with the throat portion of the envelope.

6. An envelope inserting method according to claim 4, wherein said throat opening is performed in synchronism with said conveying of the insert material in such a way that said throat opening is performed after the flap of the envelope which have inserted therein the insert material has moved past said throat opening means.

7. An envelope inserting method according to claim 1, further comprising a step of releasably holding the envelope at the opened throat portion thereof by means of a clamp.

8. An envelope inserting method according to claim 7, wherein the releasing of said holding of the envelope by said clamp is performed in synchronism with said conveying of the insert material in such a way that the releasing occurs when the insertion of the insert material into the envelope has been completed.

9. An envelope inserting method according to claim 2, further comprising a step of releasably holding the envelope at the opened throat portion thereof by means of a clamp, wherein said clamp is operable in synchronism with the rotation of said spiral member in such a way that the holding of the envelope bottom edge by said spiral member is releasable after the envelope has been held by said clamp.

10. An envelope inserting method according to claim 1, further comprising a step of supplying new envelopes for replenishing of said envelope storage station.

11. An apparatus for successively inserting insert material into envelopes each having a rear panel and a front panel with a flap portion at one end of the envelope, comprising:

conveyer means movable only in one direction along a straight path for conveying the insert material along said straight path toward an envelope inserting position of the apparatus where said insert material is inserted by said conveyer means into the envelope through an opened throat thereof and then conveying the envelope having inserted therein the insert material out of said envelope inserting position along said straight path, wherein said conveyer means includes a pushing member which is adapted to be brought into engagement with the trailing end of the insert material to push said insert material forward into the envelope and said pushing member being adapted to then be brought into engagement with the throat portion of the rear panel of the envelope thereby to push the envelope out of said envelope inserting position along said straight path;

an envelope storage station provided immediately above said envelope inserting position for storing a plurality of envelopes in a stack one above another with the front panel of each of said envelopes facing upwards; and throat opening means disposed adjacent to the upstream side of said envelope storage station, as viewed in the direction in which the insert material is conveyed, and operable to be brought into contact with the throat portion of envelope for opening the throat of that envelope;

said envelope storage station including a flap guide member disposed on the upstream side of said envelope storage station for guiding the flap portions of the envelopes and envelope feed means disposed on the downstream side of said envelope storage station for feeding the envelopes successively to said envelope inserting position.

12. An envelope inserting apparatus according to claim 11, wherein said envelope feed means includes a vertically disposed rotatable screw-like spiral member having formed in the periphery thereof a spiral groove for receiving therein the bottom edges of the respective envelopes thereby to hold such envelops at the bottom edges in such a way that the bottom edges are separated one from another, said spiral member being rotatable in such a direction that causes the bottom edges of the envelopes to move downwards with the rotation of said spiral member and then to be released successively from the holding by said spiral member.

13. An envelope inserting apparatus according to claim 12, wherein said spiral member is rotatable in synchronism with the movement of said pusher member in such a way that the release of the bottom edge of envelope from the holding by said spiral member occurs at latest when the insertion of the insert material into the envelope has been completed.

14. An envelope inserting apparatus according to claim 12, wherein said throat opening means includes a suction cup which is movable to be brought into contact with and then to pull down the throat portion of the envelope thereby to spread open the envelope throat.

15. An envelope inserting apparatus according to claim 14, wherein said suction cup is movable in synchronism with the rotation of said spiral member in such a way that the release of the bottom edge of envelope from the holding by said spiral member occurs after said suction cup has been brought into contact with the throat portion of the envelope.

16. An envelope inserting apparatus according to claim 14, wherein said suction cup is operable in synchronism with the movement of said pusher members in such a way that said suction cup is brought into contact with the throat portion of the envelope after the flap of the preceding envelope which has inserted therein the insert material has moved past said suction cup.

17. An envelope inserting apparatus according to claim 12, further comprising clamp means provided adjacent to the upstream side of said envelope storage station for holding the envelope by clamping the opened throat portion of the envelope.

18. An envelope inserting apparatus according to claim 17, wherein said clamp means is operable in synchronism with the rotation of spiral member in such a way that the holding of the envelope bottom edge by said spiral member is releasable after the envelope has been held by said clamp means.

19. An envelope inserting apparatus according to claim 17, wherein said clamp means is operable synchronously with the rotation of said spiral member in such a way that said clamp means is operated to release the holding of the envelope when insertion of the insert material into that envelope has been completed.

20. An envelope inserting apparatus according to claim 12, wherein said spiral member is adapted to receive the bottom edge of new envelopes which are supplied successively for replenishment of said envelope storage station and the spiral groove of said spiral member is formed wider at the top portion thereof than the rest of said spiral groove.

21. An apparatus for successively inserting insert material into envelopes each having a rear panel and a front panel with a flap portion at one end of the envelope, comprising:

conveyer means movable only in one direction along a straight path for conveying the insert material along said straight path toward an envelope inserting position of the apparatus where said insert material is inserted by said conveyer means into an envelope through an opened throat thereof and then conveying the envelope having already inserted therein the insert material out of said envelope inserting position in the same direction as said straight path;

an envelope storage station provided immediately above said envelope inserting position for storing a plurality of envelopes one above another in a stack with the front panel of each of said envelopes facing upwards; and throat opening means disposed adjacent to the upstream side of said envelope storage station, as viewed in the direction in which the insert material is conveyed, for opening the throat of an envelope;

said envelope storage station including envelope feed means disposed on the upstream and downstream sides of said envelope storage station, respectively, for feeding the envelopes successively to said envelope inserting position, each of said envelope feed means including a vertically disposed rotatable spiral member having formed in the periphery thereof a spiral groove, the spiral groove of one spiral member on the upstream side of said envelope inserting position being adapted to receive therein the flap edges the respective envelopes and the spiral groove of the other spiral member on the downstream side being adapted to receive therein the bottom edges the respective envelopes thereby to hold such envelops in such a way that the flap edges and the bottom edges of the envelopes are separated one from another, and said spiral members being rotatable in such a direction that causes the envelopes to move downwards and then released from the holding by said spiral members with the rotation of said spiral members;

said conveyer means including a pushing member which is adapted to be brought into engagement with the trailing end of the insert material to push said insert material forward into an envelope at the envelope inserting position and said pushing member being adapted to then be brought into engagement with the throat portion of the rear panel of the envelope thereby to push the envelope out of said envelope inserting position in the same direction as said straight path.

* * * * *